US005303283A

United States Patent [19]

Jedlitschka et al.

[11] Patent Number: 5,303,283

[45] Date of Patent: Apr. 12, 1994

[54] X-RAY UNIT WITH HIGH-VOLTAGE POWER SUPPLY DEVICE INTEGRATED INTO THE CASING

[75] Inventors: Hans Jedlitschka, Chatillon; Jacques Sireul, Wissous, both of France

[73] Assignee: General Electric CGR S.A., Issy les Mouloineaux, France

[21] Appl. No.: 936,383

[22] Filed: Aug. 28, 1992

[30] Foreign Application Priority Data

Sep. 3, 1991 [FR] France ..... 91 10889

[51] Int. Cl.[5] ..... H01J 35/10

[52] U.S. Cl. ..... 378/202; 378/200; 378/119; 378/130

[58] Field of Search ..... 378/202, 199, 203, 130, 378/131, 133, 141, 200, 142, 101, 119, 121, 127, 201

[56] References Cited

U.S. PATENT DOCUMENTS

| | | | |
|---|---|---|---|
| 4,418,421 | 11/1983 | Kitadate et al. | 378/200 |
| 4,694,480 | 9/1987 | Skillicorn | 378/110 |
| 4,720,844 | 1/1988 | Bougle | 378/101 |
| 4,920,544 | 4/1990 | Eado et al. | 375/26 |
| 4,920,554 | 4/1990 | Gabbay et al. | 378/200 |
| 4,984,261 | 1/1991 | Maldonado et al. | 378/202 |
| 5,003,452 | 3/1991 | Sireul et al. | 378/104 |
| 5,060,253 | 10/1991 | Jedlitschka et al. | 378/202 |

FOREIGN PATENT DOCUMENTS

| | | |
|---|---|---|
| 3946 | 9/1979 | European Pat. Off. . |
| 198741 | 10/1986 | European Pat. Off. . |
| 314553 | 5/1989 | European Pat. Off. . |

*Primary Examiner*—David P. Porta
*Assistant Examiner*—Don Wong
*Attorney, Agent, or Firm*—Cushman, Darby & Cushman

[57] ABSTRACT

An X-ray tube is enclosed in a casing containing a cooling fluid. At least one terminal part of the casing is elongated to house a high-voltage power supply device comprising a high-voltage output terminal connected to the anode and/or the cathode and low-voltage input terminals connected to low-voltage contact elements for connection to a low-voltage supply source that is located outside the casing.

10 Claims, 7 Drawing Sheets

X-RAY UNIT WITH HIGH-VOLTAGE POWER SUPPLY DEVICE INTEGRATED INTO THE CASING

BACKGROUND OF THE INVENTION

1. Field of the Invention

The invention relates to X-ray units that are used to generate a beam of X-rays towards a patient's body in order to take a picture of this part by various methods such as projection on a sensitive film in standard type radiology instruments or the reconstruction of a 2D or 3D image from measurements of X-radiation made at different angles in scanner type instruments.

In present technology, an X-ray unit is constituted (FIG. i) by an X-ray tube 10 and a casing 12 filled with an insulating and cooling fluid 14 in which said X-ray tube is placed. The casing 12 is opaque to X-rays except at one place 16, the place through which the radiation (arrow 26) generated by the X-ray tube is emitted. The casing 12 is provided with the electrical terminals 18 and 34 which feed from an electrical power supply externally connected to the X-ray tube. In addition holes (not shown) provided for circulation, if necessary, of insulating and cooling fluid 14 and the filling of such fluid with casing 12.

As also shown in FIG. 1, an X-ray tube comprises a filament type cathode 20 that emits an electron beam 22 towards an anode 24 or anticathode. The anode 24 is constituted by a material such as tungsten or molybdenum which emits the beam 26 of X-rays when it is bombarded by the electron beam 22 coming from the cathode 20. To obtain a high-energy electron beam, the electrons are accelerated by an intense electrical field created between the cathode 20 and the anode 24. To this end, the anode 24 is taken to a positive potential of several tens of kilovolts with respect to the cathode. This potential may exceed hundred kilovolts and reach two hundred kilovolts.

These high electrical potentials are supplied by special cables called high-voltage cables coming from a high-voltage power supply device which is placed at some distance from the casing. This distance may reach 30 meters in certain radiology instruments.

2. Description of the Prior Art

In FIG. 1, the X-ray tube is of the rotating anode type, which implies a motor constituted by a rotor 28 fixedly joined to the anode 24 and a stator 30 fixedly joined to the envelope 32 of the X-ray tube 10, these two elements 28 and 30 having to be electrically supplied by the terminal 34.

Furthermore, since the cathode 20 is of the filament type, it should also be electrically supplied by the terminal 18.

In the example of the standard type of X-ray unit according to FIG. 1, the casing is constituted by four parts 36, 38, 40 and 42 which are assembled together in an imperviously sealed way to form an enclosed chamber in which the insulating and cooling fluid circulates through means not shown in FIG. 1. It must be noted that, in certain embodiments, the two central parts form only one part.

In this casing 12, the X-ray tube 10 is kept in position by brackets or clamps such as those referenced 44 and 46 which are fixedly joined to said casing.

FIG. 2 is a simplified electrical diagram showing how the high-voltage power supply of the X-ray tube is generally implemented.

The anode 24 and the cathode 20 are connected respectively to a high-voltage supply generator 48, placed outside the casing 12, by so-called high-voltage cables 50 and 52. Such a generator 48 comprises a high-voltage supply device 54 which supplies DC high voltages and an inverter type high-frequency converter 56, which provides the device 54 with low-voltage pulse signals having a frequency of some tens of kilohertz starting from the supply voltage E of the AC mains system.

In view of the power values needed for the operation of the X-ray tube 101 this tube is, as described further above, placed in a casing 12 containing an insulating and cooling fluid. For the same reason, the high-voltage supply device 54 is placed in another casing 58 filled with an insulating and cooling fluid.

As can be seen very schematically in FIG. 2, the high-voltage power supply device 54, which is also called a "high-voltage pack", comprises a transformer 60, having only one primary winding 62 and several secondary windings $64_1$ to $64_n$. The primary winding 60 has two input terminals E1 and E2 that are connected to two output terminals of the high-frequency converter 56.

Each of the secondary windings $64_1$ to $64_n$ is connected to a rectifier and filtering circuit represented schematically by a diode D and a capacitor C, and the secondary windings are connected to each other in such a way that their output voltages get added up to obtain the desired high voltage.

A single-pole supply voltage is obtained by placing the supply conductor of the cathode (cable 52) at the potential of the ground while a symmetrical two-pole supply voltage is obtained by placing the midpoint M of the secondary circuits at the potential of the ground.

A power supply device such as this for an X-ray tube comprising high-voltage cables 50 and 52 has the following drawbacks:

- two casings containing insulating and cooling liquids are used, one 12 for the X-ray tube 10 and the other 58 for the high-voltage power supply device, and the result thereof is an increased cost of the X-ray unit;
- the high-voltage cables 50 and 52 are specially built, and are therefore costly;
- the parasitic capacitance of the high-voltage cables 50 and 52 is all the greater as the cables are long, thus limiting the speed of build-up of the high voltage on the X-ray tube;
- as a result of the complex movements of the support of the X-ray unit, the high-voltage cables 50 and 52 are subjected to major mechanical strains that lead to problems related to reliability, safety and economy.

It is an object of the present invention, therefore, to make a high-voltage power supply device for an X-ray tube that does not have the drawbacks due to the use of special high-voltage cables.

This object is achieved through the use of a high-voltage power supply device, the dimensions of which are such that it can be placed inside the casing of the X-ray unit and can thus be in the immediate vicinity of the X-ray tube to be supplied. Thus, there is no longer any need for special high-voltage cables.

Such a high-voltage power supply device has been described in the U.S. Pat. No. 5,003,452.

To enable this power supply device to be placed in the casing of the X-ray unit, it is necessary to modify said casing and, notably, to extend it, either on the cathode side or on the anode side or on both sides. Furthermore, certain devices and protection elements have to be provided for.

SUMMARY OF THE INVENTION

The invention therefore relates to an X-ray unit constituted by an X-ray tube placed inside a chamber or casing filled with an insulating and cooling fluid, said casing comprising at least three assembled parts, at least one open central part supporting said tube and two terminal parts closed at one end and joined, at the other open end, in an imperviously sealed way, to said central part, wherein said casing furthermore contains at least one high-voltage power supply device, at least one high-voltage output terminal of which is connected to at least one high-voltage electrode of the X-ray tube and wherein at least one of the lateral parts of said casing is elongated so as to enable the positioning of said high-voltage power supply device, said elongated lateral part comprising means to fix said high-voltage power supply device to the casing and to connect it electrically to a low-voltage source placed outside said casing.

Should said cathode be grounded, the high-voltage power supply device is placed on the anode side so that the high-voltage output terminal of said high-voltage power supply device is connected to the anode by a short conductor, the low-voltage input terminals being connected to low-voltage contact elements placed on the casing in the immediate vicinity.

Should the anode be grounded, the high-voltage power supply device is placed on the cathode side so that the high-voltage output terminal of said high-voltage power supply device is connected to the cathode by a short conductor, the- low-voltage input terminals being connected to low-voltage contact elements placed on the casing in the immediate vicinity.

Should the anode be at a positive high voltage and the cathode at a negative high voltage, two high-voltage power supply devices are used, one placed on the anode side to supply this anode, and the other placed on the cathode side to supply this cathode.

To obtain a two-pole power supply of the tube by means of only one high-voltage power supply device, the latter may be placed on one side of the tube or on the other, but a guide should be provided to make the high-voltage conductor pass to the other side of the tube with respect to the side on which the high-voltage power supply device is placed.

Means for the protection of the high-voltage power supply device and of the high-voltage conductors should be provided to protect them against X-radiation and against the calorific radiation of the tube.

BRIEF DESCRIPTION OF THE DRAWINGS

Other objects, characteristics advantages of the present invention shall appear from the following description of exemplary embodiments, said description being made with reference to the appended drawings, of which.

MORE DETAILED DESCRIPTION

Figure 1:
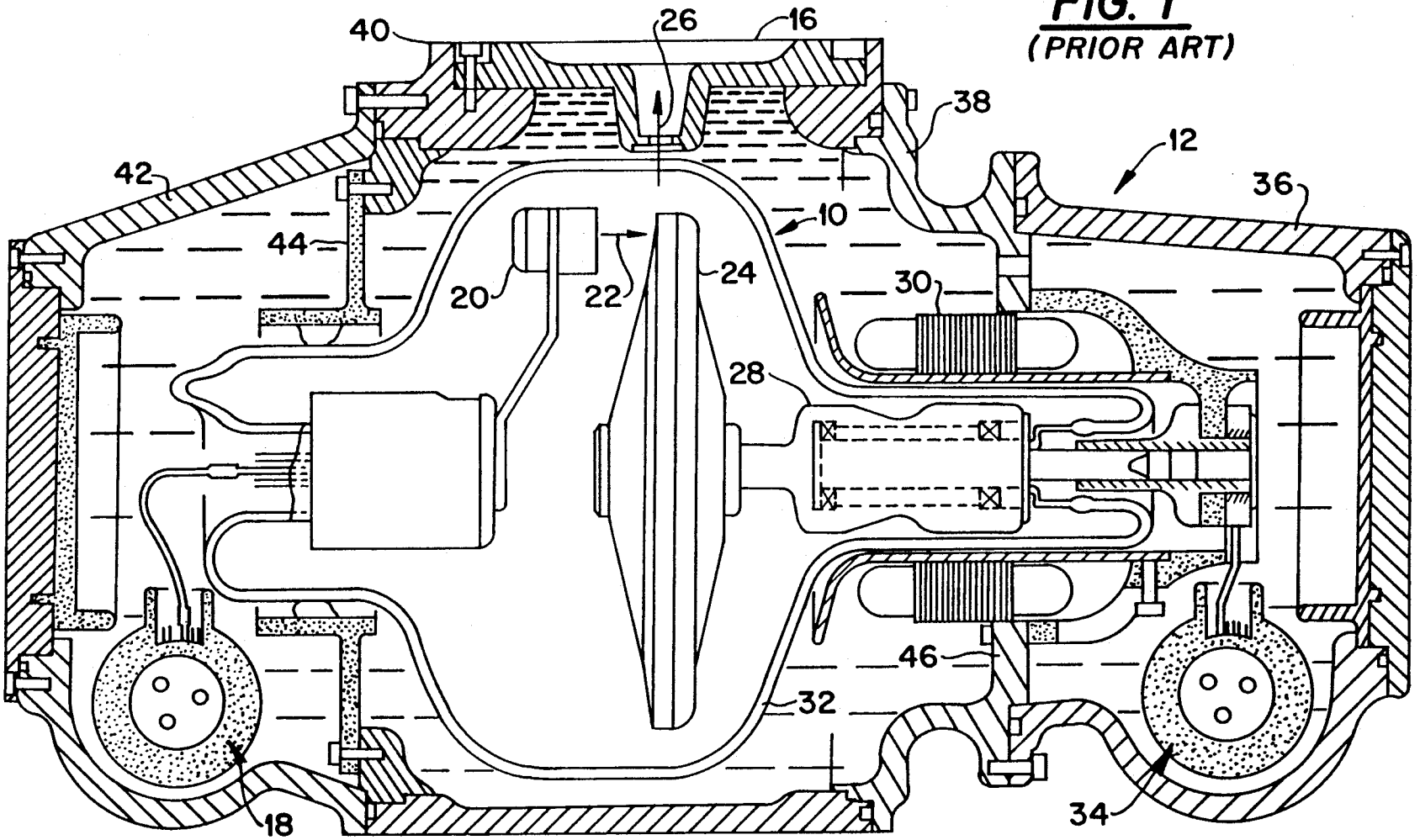
FIG. 1 (PRIOR ART)
FIG. 1 shows a schematic sectional view of a prior art X-ray unit in which the casing 12 contains the X-ray tube 10 and the insulating and cooling fluid 14.
Figure 2:
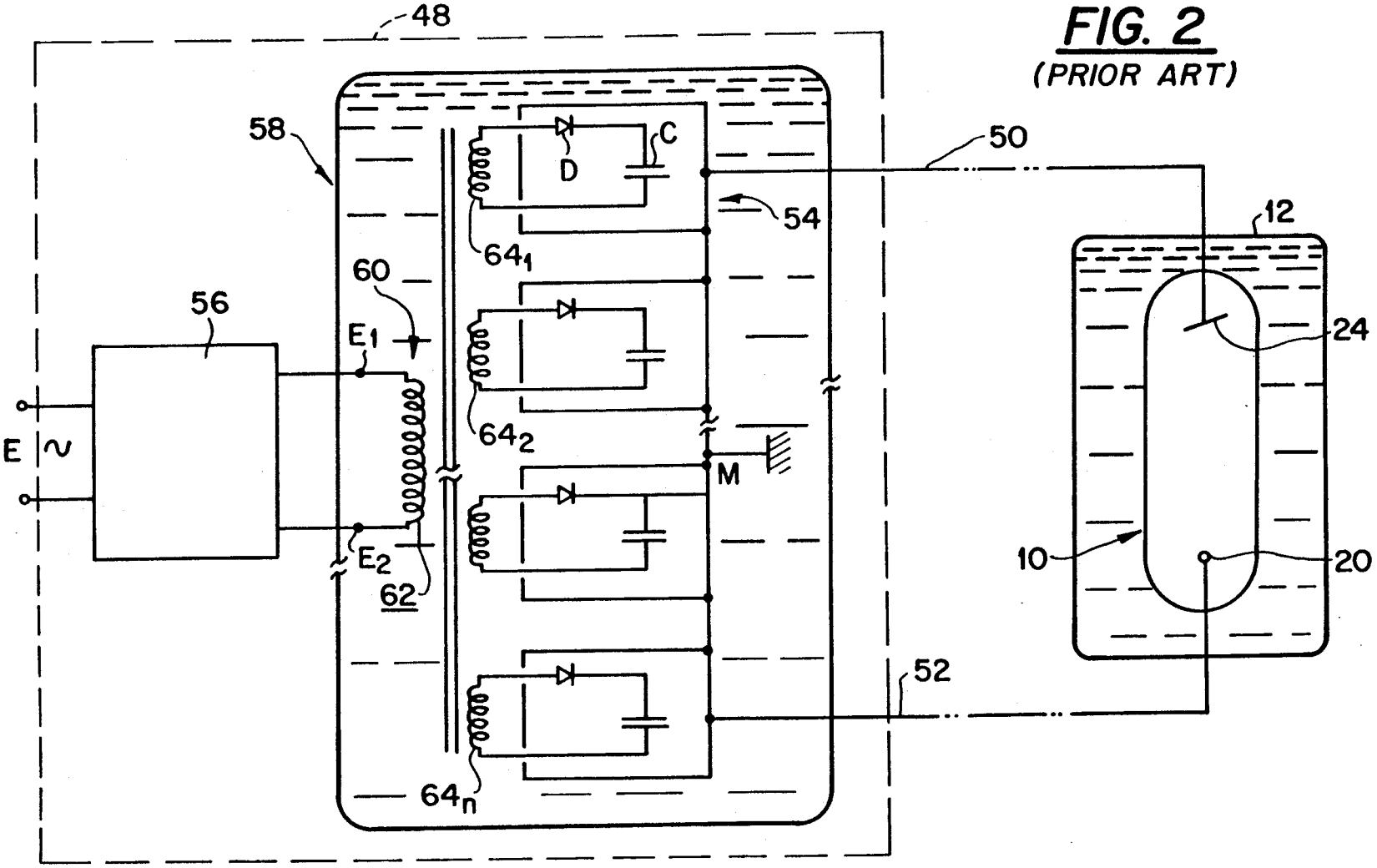
FIG. 2 (PRIOR ART)
FIG. 2 is an electrical diagram of a high-voltage power supply device of a prior art X-ray tube.

FIGS. 1 and 2, which have been used in the preamble to define the prior art, shall not be described again.

Furthermore, in the different FIGS., identical references designate the same elements. Moreover, to facilitate the correspondence amongst FIGS. 1, 2, 3, 4 and 5, certain references of FIGS. 1 and 2 have been repeated in FIGS. 3, 4 and 5 but have been assigned a subscript "1" or "2" depending on whether they correspond respectively to a high-voltage connection to the anode or to a high-voltage connection to the cathode.

According to the invention it is proposed to modify notably the terminal parts 36 and/or 42 of a casing so as to enable the placing of at least one high-voltage power supply device made in a particular manner in accordance with the above-mentioned U.S. patent.

Figure 3:
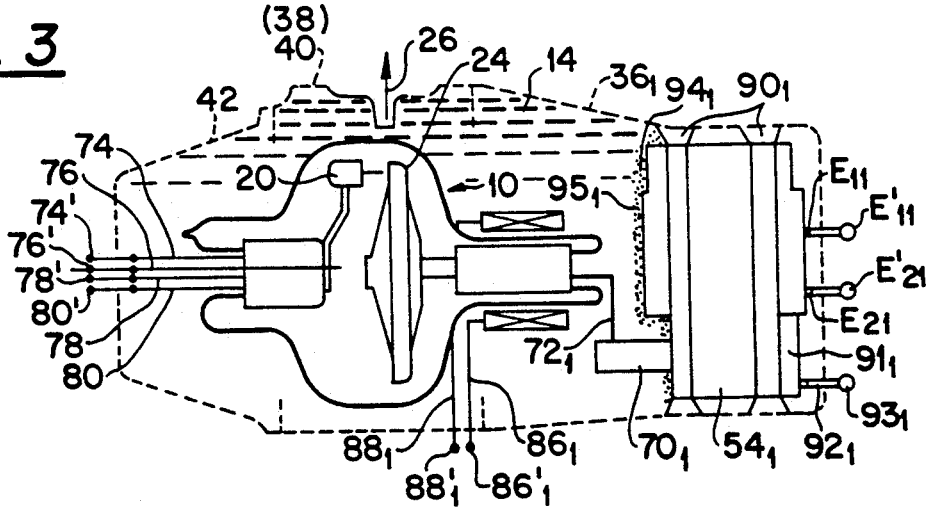
FIGS. 3, 4 and 5 are schematic sectional views of X-ray units according to the invention.
Figure 4:
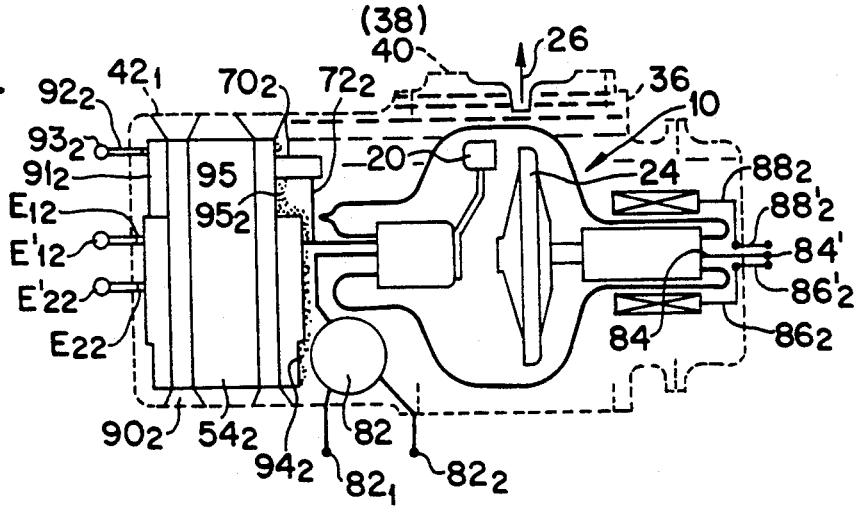
Figure 5:
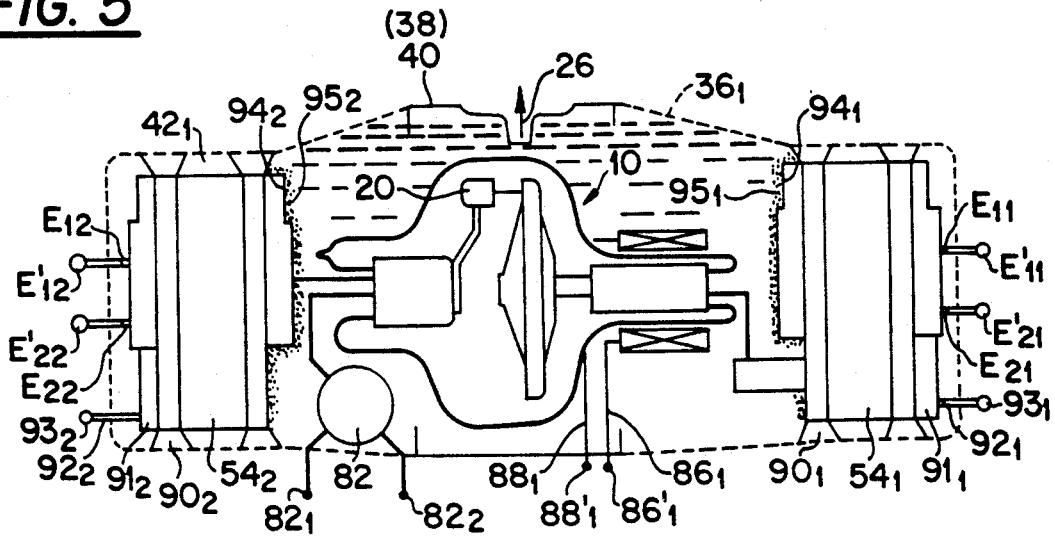

In the new casing, the high-voltage power supply device is placed preferably on the anode side of the X-ray tube in the case of a single-pole assembly called a "grounded cathode" assembly (reference $\mathbf{54}_1$ of FIG. 3) and on the cathode side of the X-ray tube in the case of a single-pole assembly called a "grounded anode" assembly (reference $\mathbf{54}_2$ of FIG. 4). In the case of a two-pole assembly, since the cathode is at a negative voltage and since the anode is at a positive voltage, two high-voltage power supply devices $\mathbf{54}_1$ and $\mathbf{54}_2$ can be placed inside the new casing, one device $\mathbf{54}_2$ on the cathode side and the other device $\mathbf{54}_1$ on the anode side (FIG. 5).

It is also possible to obtain a two-pole assembly with a single supply device, placed on the anode side ($\mathbf{54}_1$) or cathode side ($\mathbf{54}_2$), with a midpoint M at the ground (FIG. 2); in such an assembly, a high-voltage cable should be passed along the X-ray tube and some precautionary measures have to be taken, as shall be indicated here below, to insulate it electrically from the casing and to protect it against the X-radiation and the calorific radiation of the tube.

In FIG. 3, to place a high-voltage power supply device $\mathbf{54}_1$ (similar to the device 54 of FIG. 2) on the anode side, the terminal part 36 of the casing 12 is elongated, and in this case bears the reference $\mathbf{36}_1$. It is elongated as to encase the device $\mathbf{54}_1$ and hold it in position by clamps $\mathbf{90}_1$.

The two input terminals $E_{11}$ and $E_{21}$ of the primary winding are respectively connected to the contact elements $E'_{11}$ and $E'_{21}$ fixedly joined to the casing, and no particular precaution of insulation is needed since the primary winding is at the low voltage.

The high-voltage output terminal $\mathbf{70}_1$ of the device $\mathbf{54}_1$ is connected to the anode 24 by a conductor $\mathbf{72}_1$.

The stator is supplied by two conductors $86_1$ and $88_1$ which are respectively connected to two contact elements $86'_1$ and $88'_1$ fixedly joined to the casing.

Since the cathode is grounded, the filament of the cathode is supplied by two conductors 74 and 76, one of which is grounded. If the cathode has a concentration element it is biased at a negative voltage with respect to the ground by two conductors 78 and 80, one of which is grounded. These four conductors 74, 76, 78 and 80 are connected respectively to output contact elements 74', 76', 78' and 80' borne by the casing 12, and no particular precaution of insulation is needed since the cathode is grounded.

Like the parts 40 and 42, the internal wall of the elongated part $36_1$ is covered with a layer of lead (not shown) which absorbs the X-radiation. According to the invention, provision is also made for shielding the device $54_1$ against X-radiation by covering the side of the device $54_1$ which is adjacent to the tube by means of a layer $94_1$ of lead.

Since the tube radiates heat owing to the fact that its anode is at very high temperature, it is provided that the lead layer $94_1$ will be covered with a coating that reflects calorific radiation, such as a layer $95_1$ of aluminium.

To be given its full range of functions, the device $54_1$ has a known type of high-voltage measuring device $91_1$ (shown in FIG. 6 . . . elements 108, 109) associated with it. This device $91_1$ is connected to an output terminal $93_1$ on the casing part $36_1$ by a conductor $92_1$.

In FIG. 4, to place a power supply device $54_2$ on the cathode side, the terminal part 42 of the casing 12 is elongated, and then bears the reference $42_1$, so as to encase the device $54_2$ and keep it in place by way of clamps $90_2$.

The two input terminals $E_{12}$ and $E_{22}$ of the primary winding are respectively connected to the contact elements $E'_{12}$ and $E'_{22}$ fixedly joined to the casing and no particular precaution of insulation is needed since the primary winding is at low voltage.

The high-voltage output terminal $70_2$ of the device $54_2$ is connected to the cathode 20 by a conductor $72_2$.

Since the cathode is at the high voltage, the filament of the cathode is supplied by a heating transformer 82, the secondary winding of which is at the high voltage and, for this reason, the transformer 82 should be placed in the casing 12 and should be held in position on the casing 12 and on the device $54_2$ by any known means.

The power supply device $54_2$ on the cathode side, comprises a layer of lead $94_2$ coated with a layer of aluminuim $95_2$. A high-voltage measuring circuit $91_2$ is associated with this power supply device and is connected to an output terminal $93_2$ on the casing by a conductor $92_2$.

The stator is supplied by means of conductors $86_2$ and $88_2$ connected respectively to terminals $86'_2$ and $88'_2$ while the anode is connected to a terminal 84'.

In FIG. 5, the cathode is at a negative high voltage with respect to the ground and the anode is at a positive high voltage. These high voltages are obtained by a high-voltage power supply device $54_2$, analogous to that of FIG. 4, for the cathode and by a high-voltage power supply device $54_1$, analogous to that of FIG. 3, for the anode. The diagram of FIG. 5 therefore results from the combination of the diagrams of FIGS. 3 and 4.

As FIG. 2 shows, it is possible to obtain a two-pole supply of the tube by using only one device $54_1$ or $54_2$ as can be seen respectively in FIGS. 3 and 4, but by providing for a midpoint M. In this case, one of the high-voltage conductors (50 or 52 of FIG. 2) should be passed into the space between the tube 10 and the casing 12 and some precautionary measures have to be taken to insulate it electrically from the casing which is grounded and to protect it against the X-radiation and calorific radiation from the tube which has detrimental effects on the coatings of the conductors.

For the electrical insulation, it is possible to use a standard-type cable which is implemented to connect the device 54 (FIG. 2) to a tube at a distance. However, such a cable is not designed to withstand the 80° C. temperature of the insulating and cooling fluid contained in the casing, nor is it designed to withstand X-radiation.

Thus, the invention provides for making this cable pass through a conductor or guide (not shown) which is heat-insulating and is coated with a layer of lead to shield from X-radiation.

To make it possible for the high-voltage power supply devices $54_1$ and/or $54_2$ to be placed within the casing 12, their dimensions have to be small enough for them to come within the present diameter dimensions of the casings used, the only dimension to be modified being the longitudinal dimension of the casing by the elongation of the terminal parts 36 and/or 42.

Such a high-voltage power supply device has been described in the above-mentioned U.S. patent which is incorporated into the present application by reference, but a brief description thereof shall be given hereinafter with reference to FIGS. 6, 7, 8 and 9 which correspond respectively to FIGS. 1, 2, 3 and 6 of said U.S. patent.

Figure 6:
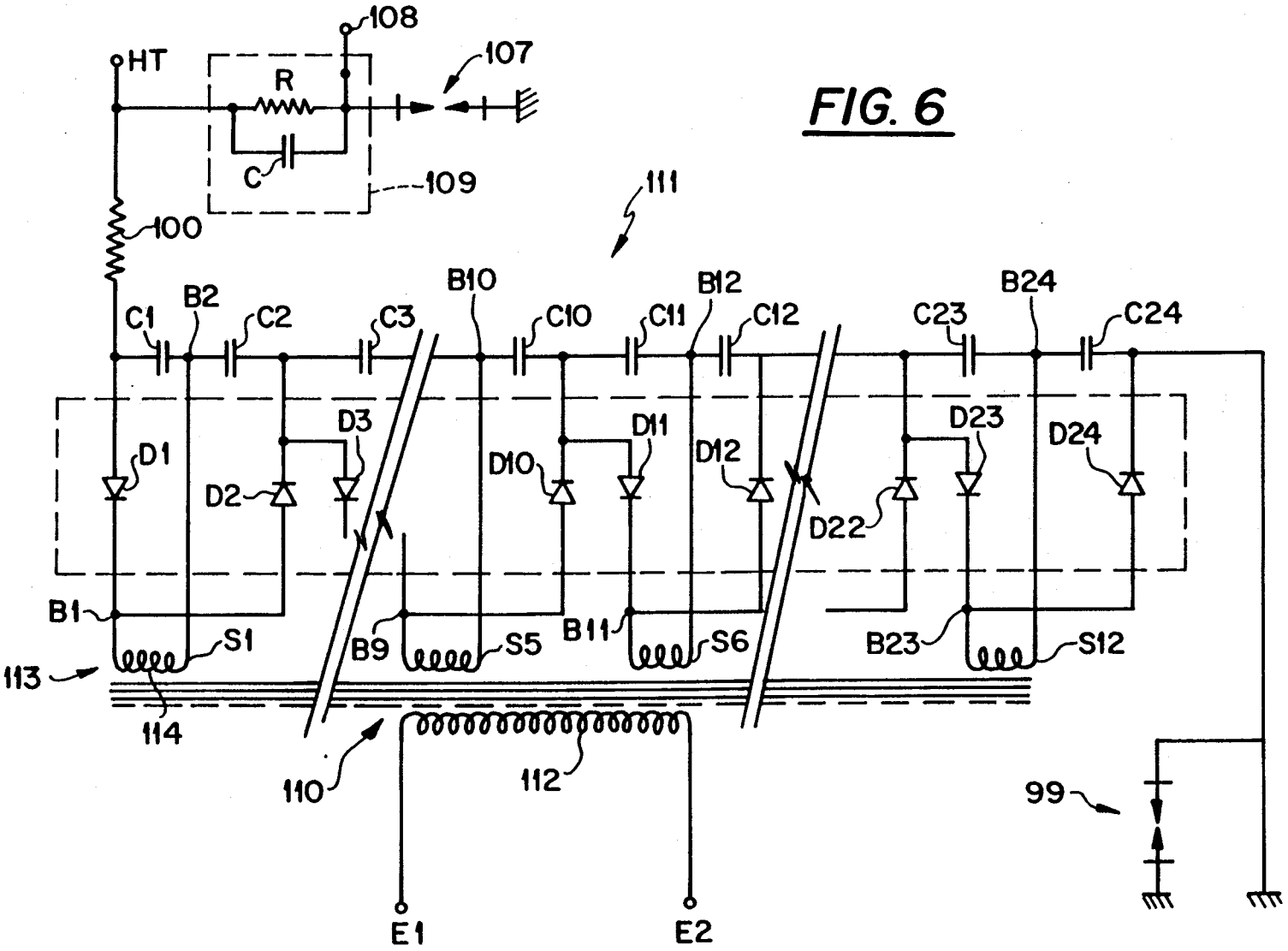
FIG. 6 is a standard electrical diagram of a high-voltage power supply device for an X-ray tube corresponding to the one referenced 54 in FIG. 2.

In FIG. 6, the high-voltage power supply device 111 for an X-ray tube comprises a transformer 110 which comprises a primary winding 112 and twelve secondary windings S1 to S12, of which only the windings S1, S5, S6 and S12 have been shown. Similarly, the device comprises twenty-four identical rectifier diodes D1 to D24, of which only the elements D1, D2, D3 . . . D12, D13, D14 . . . D22, D23, D24 have been shown.

It also includes twenty-four filtering capacitors C1 to C24, of which only the elements C1, C2, C3 . . . C12, C13, C14 . . . C22, C23, C24 have been shown.

Each secondary winding S1 to S12 comprises two output terminals. The output terminals all bear the references B1 to B24, only the terminals B1, B2, B3 . . . B5, B6, B7, B8 . . . B22, B23, B24 having been shown.

In FIG. 6, the common point of the capacitor C1 and of the diode D1 constitutes the high-voltage output terminal HT through a resistor 100 while the common point of the capacitor C24 and of the diode D24 constitutes the ground output terminal with which a spark gap 99 is associated.

A device 109 for the measurement of the high voltage is connected between the high-voltage terminal HT and the ground by means of a spark gap 107. This device 109 comprises, in a standard way, a resistor R and a capacitor C in parallel. A measuring terminal 108 is connected to the side on which the spark gap 107 is connected.

In order to limit the lengths of the connection conductors which connect the output terminals B1 to B24 of the secondary windings S1 to S12, firstly to the diodes D1 to D24 and, secondly, to the capacitors C1 to C24, there is provision, first of all, for making secondary windings that have their similar odd-order output terminals B1, B3 . . . B23 positioned on a first lateral side of the windings while the even-order output terminals B2,

B4 . . . B24 are positioned on the other side, namely the second lateral side, of the secondary windings.

There is also provision for grouping the diodes D1 to D24 together on the same support, which is placed on the side having the output terminals B1, B3 . . . B23 of the secondary windings. For the same reason, the capacitors C1 to C24 are positioned on the external periphery of the secondary windings and are connected, firstly, to the diodes D1 to D24 on the first lateral side of the secondary windings and, secondly, to the output terminals B2, B4 . . . B24 on the second lateral side of the secondary windings.

Figure 7:
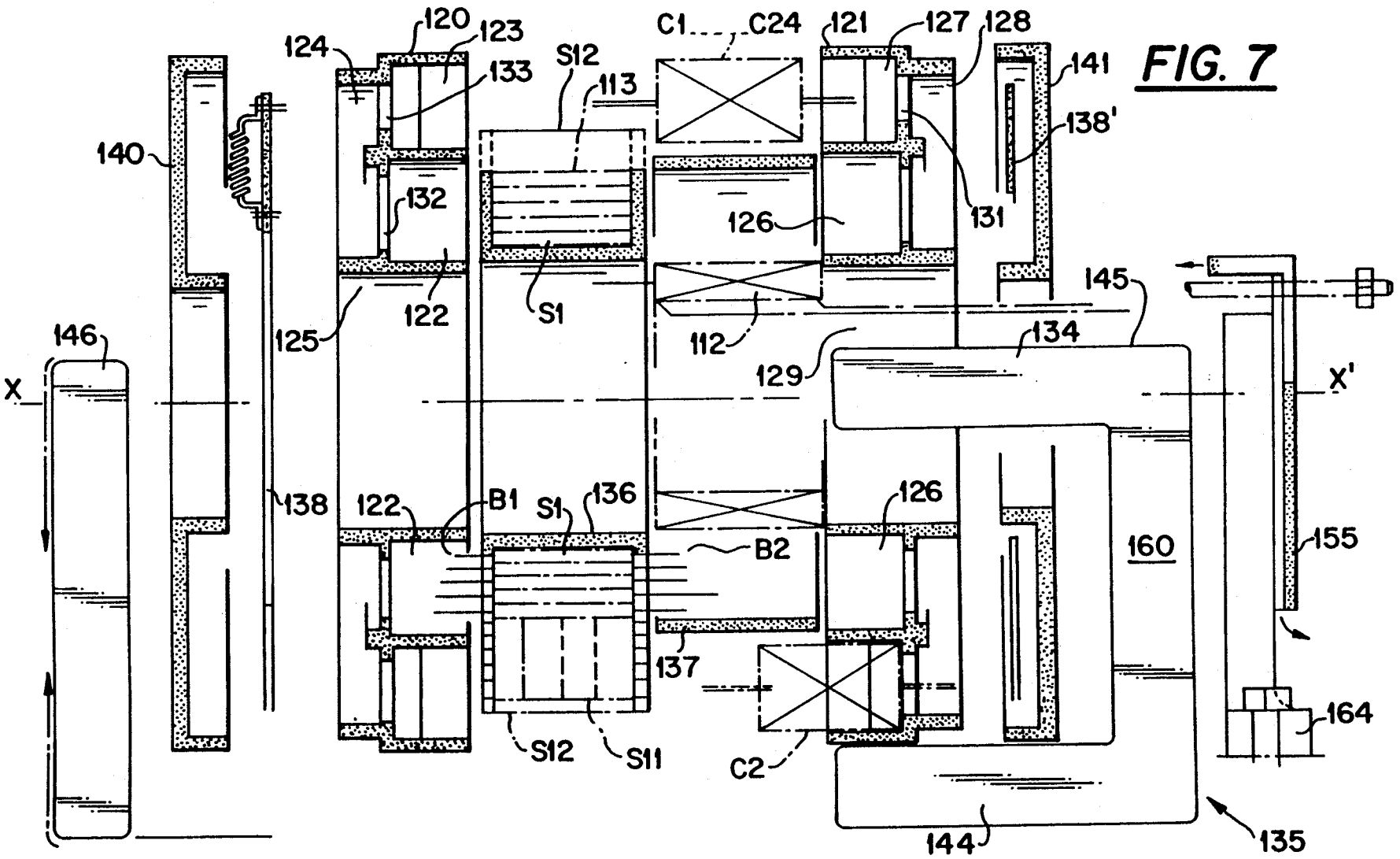
FIG. 7 shows an exploded sectional view of a preferred embodiment of the high-voltage power supply device, the small dimensions of which enable it to be placed within the casings currently available on the market.
Figure 8:
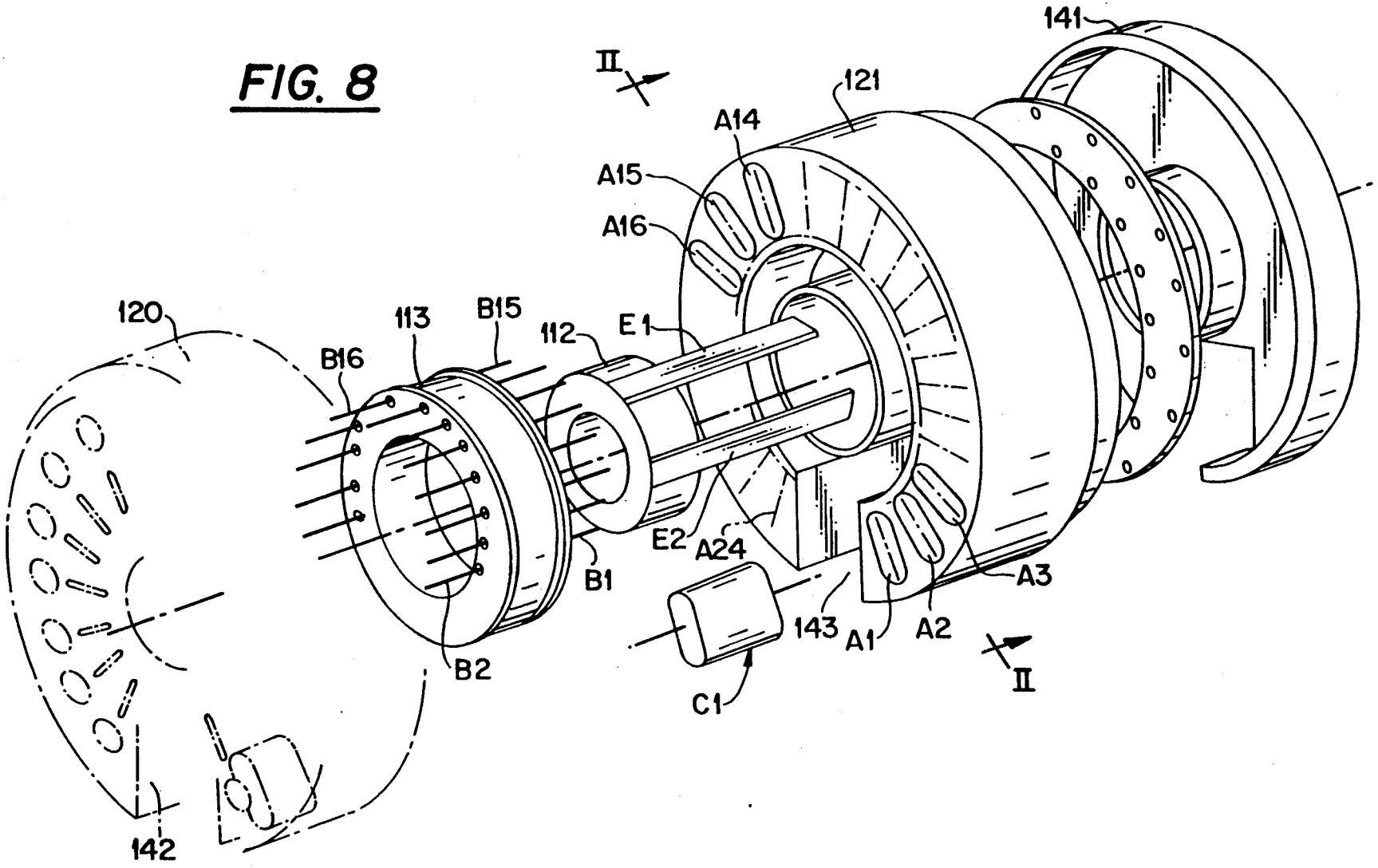
FIG. 8 shows an exploded view in cavalier perspective of a part of the elements constituting the high-voltage power supply device.

This particular arrangement of the different elements shall be understood more clearly from the description of FIGS. 7 and 8 in which the elements identical to those of FIG. 6 bear the same references.

The device has two half-shells 120 and 121 in which housings are provided in order to place the primary winding 112, the secondary windings S1 to S12, the capacitors C1 to C24 and the diodes D1 to D24. To this end, each half-shell 120 (or 121) has three annular compartments 122, 123 and 124 (or 126, 127, 128) around a cylindrical central part 125 (or 129).

The first annular compartment 122 (or 126) is at the periphery of the central part 125 (or 129) while the second annular compartment 123 (or 127) at the external periphery of the first compartment 122 (or 126). The third compartment 124 (or 129) is positioned laterally with respect to the first two compartments 122 and 123 (or 126 and 127) and is separated from them by partition walls 130 and 131 respectively (or 132 and 133) pierced with holes.

The central parts 125 and 126 are designed to house, notably, the primary winding 112 and an arm 134 of the magnetic circuit 135 of the transformer 110. The first annular compartments 122 and 126 are designed to house the secondary windings 113 which are coiled on a spindle 136. The external periphery of the spindle 136 is closed by a lid constituted by a cylindrical ring 137. The spindle 136 and its lid 137 get fitted into the compartments 122 and 126. The second annular compartments 123 and 127 have twenty-four recesses A1, A2, A3 . . . A14, A15, A16 . . . A24 which are designed to house respectively the twenty-four capacitors C1 to C24 respectively. The third compartment 124 of the half-shell 120 is designed to house the diodes D1 to D24 and to make the connections between them, with the capacitors C1 to C24 and with certain output terminals of the secondary windings S1 to S12 by means of a printed circuit 138.

The third compartment 128 of the half-shell 121 is designed to make the different connections between certain output terminals of the secondary windings S1 to S12 and the capacitors C1 to C24 by means of a printed circuit 138' in the form of an annular plate sector.

Each annular compartment 124 or 128 is respectively closed by an annular lid 140 or 141 which gets fitted into the external rim of the associated compartment.

For the magnetic circuit 135 to be positioned in the vicinity of the secondary windings, each half-shell 120 (or 121) has its rim interrupted by a notch 142 (or 143) and the same is true of each lid 140 (or 141). Such a notch enables an arm of said magnetic circuit to be passed through it.

The diodes D1 to D24 are positioned on the printed circuit 138, in the form of an annular plate sector, which sets up their connections with one another, with one end of the capacitors C1 to C24 and with the output terminals B1, B3 . . . B23 in accordance with the electrical diagram of FIG. 6. It is thus that, for example, the diode D1 has its cathode connected to the terminal B1 of the winding S1 and its anode connected to one of the ends of the capacitor C1. Furthermore, the terminal B1 is connected to the anode of the diode D2, the cathode of which is connected, on the one hand, to the anode of the diode D3 and, on the other hand, to one end of the capacitors C2 and C3 by a printed conductor. It will be noted that the other printed conductors connect the other common points of the diodes equivalent to D2, D3 to the capacitors equivalent to C3.

Figure 9:
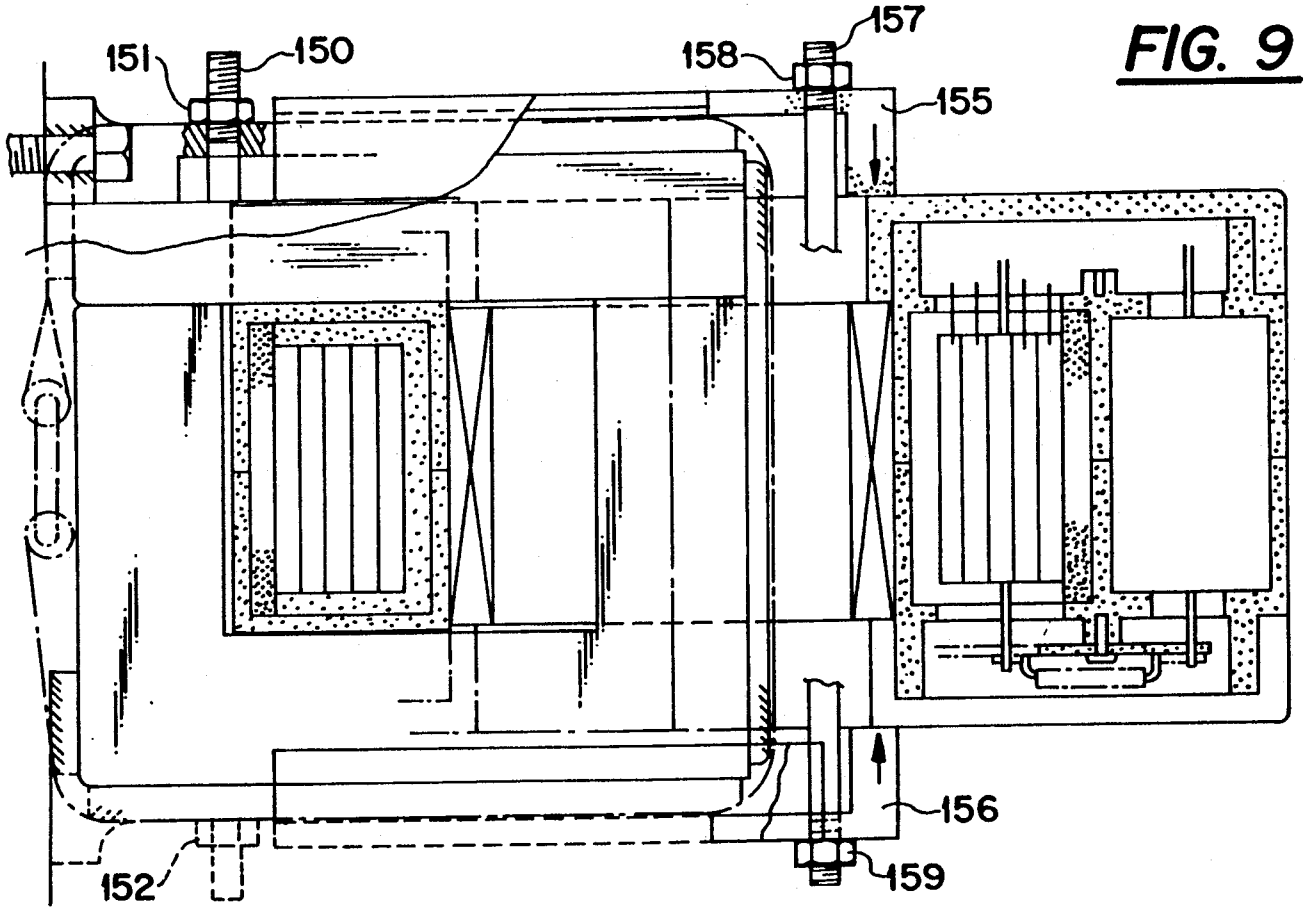
FIG. 9 shows a sectional view of the entire high-voltage power supply device according to the invention, along the axis x'x and going through the magnetic circuit of the transformer.

The different elements that have just been described with reference to FIGS. 6 to 9 are assembled by being fitted into one other and held in position with respect to one another by joining elements so as to obtain the assembly shown in a partial sectional view in FIG. 9. The joining elements, which are not shown in FIGS. 6 to 8, are constituted by threaded tie-rods and nuts and plates used to support and hold different arms of the magnetic circuit 135.

It is thus that the elements of FIG. 7 are held by two threaded tie-rods and nuts such as those referenced 150, 151 and 152 (FIGS. 7 and 9), the tie-rods being housed in holes going right through the elements of FIG. 7 along an axis parallel to the axis of symmetry x'x.

Furthermore, to support and hold the magnetic circuit 135, there is provision for plates 155 and 156 (FIGS. 7 and 9), these boards being held respectively against the lids 141 and 140 by threaded tie-rods and nuts such as those bearing the references 157, 158 and 159 in FIG. 9. These plates 155 and 156 are designed to house and hold each arm of the magnetic circuit. Thus, the plate 155 supports the arm 160 of the U-shaped part while the plate 156 bears the arm 146 of the magnetic circuit which closes the U-shaped opening.

What is claimed is:

1. An imperviously sealed casing for an X-ray device having a least one elongated end, sad casing being formed from the assembly of at least three assembly parts including at least one intermediate component joined to at least two abutting end components at opposite ends thereof, said casing further comprising:

an X-ray tube, attachably supported by said intermediate component, placed inside a chamber of the casing which is filled with an insulating and cooling fluid;

at least one high-voltage power supply having at least one high-voltage output terminal and at least one low-voltage input terminal, said at least one high-voltage output terminal being connected to a high-voltage electrode of the X-ray tube;

said at least one high-voltage power supply positioned within said casing at a corresponding at least one elongated end; and means for fixing said at least one high-voltage power supply to the inside of said casing and within said chamber filled with the insulating and cooling fluid, said at least one high-voltage power supply being electrically coupled to one of said at least one low-voltage input terminals for adaptable connection to a low-voltage source means located outside the casing.

2. The imperviously sealed casing of claim 1, wherein at least one side of said at least one high-voltage power supply includes means for protecting said power supply against X-radiation and calorific radiation from said X-ray tube.

3. The imperviously sealed casing of claim 2, wherein said protecting means includes;

a first layer made from an X-ray absorbing material; and a second layer made from a calorific radiation reflecting material coated over said first layer.

4. The imperviously sealed casing of claim 3, wherein said first layer is lead and the second layer is aluminum.

5. The imperviously sealed casing of any one of claims 1 to 4, wherein said X-ray tube is of the rotating anode type and includes a grounded cathode and a rotating anode, said at least one high-voltage power supply being positioned along an anode side of said X-ray tube; and wherein said at least one high-voltage output terminal connected to said corresponding at least one high-voltage power supply is also coupled to the rotating anode by a short conductor, the casing further comprising:

first low-voltage contact elements for coupling the low-voltage input terminals to the low-voltage source means;

second low-voltage contact elements for adaptably coupling a stator associated with a motor of said rotating anode to a supply source located outside the casing;and third low-voltage contact elements for adaptably coupling the grounded cathode to electrical sources outside the casing.

6. The imperiously sealed casing of any one of claims 1 to 4, wherein said X-ray tube is of the rotating anode type and includes a grounded rotating anode and a filament type cathode, said at least one high-voltage power supply being positioned along a cathode side of said X-ray tube; and wherein said at least one high-voltage output terminal connected to said corresponding at least one high-voltage power supply is also coupled tot he cathode by a short conductor;

the casing further comprising:

first low-voltage contact element for coupling the low-voltage input terminals to the low-voltage source means;

second low-voltage contact elements for adaptably coupling a stator associated with a motor of said rotating anode to a supply source located outside the casing as well as for adaptably connecting said rotating anode to ground; and a heating transformer coupled to a filament of the cathode, said transformer having its secondary winding generating a high-voltage level, and input terminals of its primary winding connected to third low-voltage contact elements which adaptably connect said transformer to a supply source located outside the casing.

7. The imperviously sealed casing of any one of claims 1 to 4, wherein said X-ray tube is of the rotating anode type and includes a positive high-voltage rotating anode and a negative high-voltage filament type cathode, said casing further comprising:

a first one of said at least one high-voltage power supplies positioned along an anode side of said X-ray tube, said first high-voltage power supply having a high-voltage output terminal connected to said rotating anode by a first short conductor as well as low-voltage input terminals coupled thereto;

a second one of said at least one high-voltage power supplies positioned along a cathode side of said X-ray tube, said second high-voltage power supply having a high-voltage output terminal connected to said cathode by a second short conductor as well as low-voltage input terminals coupled thereto;

first low-voltage contact elements for coupling the low-voltage input terminals of the first high-voltage power supply to a first voltage source of said low-voltage source means;

second low-voltage contact elements for coupling the low-voltage input terminals of the second high-voltage power supply to a second voltage source of said low-voltage source means;

third low-voltage contact elements for adaptably coupling a stator associated with a motor of said rotating anode to a supply source located outside the casing; and a heating transformer a secondary winding of which is coupled to the high-voltage terminal of the second high-voltage power supply and a primary winding of which is coupled to fourth low-voltage contact elements which adaptably connect said transformer to a supply source located outside the casing.

8. The imperviously sealed casing of any one of claims 1 to 4, wherein said X-ray tube is of the rotating anode type and includes a positive high-voltage rotating anode and a negative high-voltage cathode;

wherein said at least one high-voltage power supply is a single power supply and is positioned on either side of said X-ray tube, said single power supply including a grounded midpoint so as to generate the positive and negative voltages at said rotating anode and cathode respectively; and wherein the X-ray tube includes first and second electrodes connecting it to said single power supply by one of a short and a long conductor respectively said long conductor including means for protecting said single power supply against X-radiation from the X-ray tube as well as for providing electrical and calorific insulation to said single power supply.

9. The imperviously sealed casing of claim 8, wherein the electrical and calorific insulation means as well as the means of protection against X-radiation are formed by a conduit through which said long conductor passes.

10. The imperviously sealed casing of any one of claims 1 to 4, further comprising means for measuring a value of the high-voltage generated by each corresponding at least one high-voltage power supply, said measuring means being connected by a conductor to an output terminal on the casing.

* * * * *

UNITED STATES PATENT AND TRADEMARK OFFICE
CERTIFICATE OF CORRECTION

PATENT NO. : 5,303,283

DATED : April 12, 1994

INVENTOR(S) : JEDLITSCHKA et al

It is certified that error appears in the above-identified patent and that said Letters Patent is hereby corrected as shown below:

Column 1, line 17, change "(FIG. i)" to --(FIG. 1)--;
line 22, delete "the";
line 24, after "addition" insert --,--; and
line 25, after "(not shown)" insert --are--.

Column 2, line 14, change "101" to --10--; and
lines 55-56, change "economy" to --ergonomy--.

Column 3, lines 41 and 42, change "high voltage" to --high-voltage--; and
line 59, after "characteristics" insert --and--.

Column 4, line 66, change "low voltage" to --low-voltage--.

Column 5, line 40, change "low voltage" to --low-voltage--; and
line 60, change "low voltage" to --low-voltage-- and change "low voltages" to --low-voltages--.

Column 6, line 12, delete "."; and
line 55, change "high voltage" to --high-voltage--.

Column 7, line 33, change "126" to --129--.

Column 8, line 15, change "other" to --another--;
line 31, change "141 and 140" to --140 and 141--;
line 41, change "a" to --at--, and "sad" to --said--; and
line 63, change "terminals" to --terminal--.

Column 9, line 34, change "imperiously" to --imperviously--;

UNITED STATES PATENT AND TRADEMARK OFFICE

CERTIFICATE OF CORRECTION

PATENT NO. : 5,303,283

DATED : April 12, 1994

INVENTOR(S) : Hans Jedlitschka, et al.

It is certified that error appears in the above-indentified patent and that said Letters Patent is hereby corrected as shown below:

Column 9, line 43, change "tot he" to --to the--.

Signed and Sealed this

Tenth Day of October, 1995

*Attest:*

*Attesting Officer*

BRUCE LEHMAN

*Commissioner of Patents and Trademarks*